US009289337B2

(12) United States Patent
Fritsche et al.

(10) Patent No.: US 9,289,337 B2
(45) Date of Patent: Mar. 22, 2016

(54) WHEELCHAIR RAMP FOR A RIDE VEHICLE

(75) Inventors: Joel L. Fritsche, Glendale, CA (US); Don Robert Hilsen, La Canada, CA (US); William Lawrence Wolf, North Hollywood, CA (US); Charles Albert Flueck, Los Angeles, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 1389 days.

(21) Appl. No.: 12/211,584

(22) Filed: Sep. 16, 2008

(65) Prior Publication Data

US 2010/0066111 A1 Mar. 18, 2010

(51) Int. Cl.

| | |
|---|---|
| ***A61G 3/06*** | (2006.01) |
| *A63G 1/00* | (2006.01) |
| *A63G 7/00* | (2006.01) |
| *A63G 27/00* | (2006.01) |

(52) U.S. Cl.

CPC . *A61G 3/061* (2013.01); *A63G 1/00* (2013.01); *A63G 7/00* (2013.01); *A63G 27/00* (2013.01)

(58) Field of Classification Search

CPC ..... A61G 3/061; A61G 3/06; A63G 27/00; A63G 7/00; A63G 1/00; B62D 39/00; B65G 69/28

USPC ..... 104/18, 20, 21, 35, 53, 69, 27, 28, 30, 104/31; 198/324, 327, 735.6; 296/50, 51, 296/57.1, 61; 414/333, 396, 522, 537, 414/140.1, 140.5; 14/71.1, 69.5, 71.5, 71.7

See application file for complete search history.

(56) References Cited

U.S. PATENT DOCUMENTS

| | | | | |
|---|---|---|---|---|
| 3,584,584 | A * | 6/1971 | Milenkovic | 410/1 |
| 5,564,984 | A | 10/1996 | Mirabella et al. | |
| 5,935,011 | A | 8/1999 | Morgan et al. | |
| 5,988,073 | A * | 11/1999 | Eriksson | 105/355 |
| 6,227,790 | B1 | 5/2001 | Mollick et al. | |
| 6,292,968 | B1 * | 9/2001 | McLain | 14/71.1 |
| 6,340,280 | B1 | 1/2002 | Mollick et al. | |
| 6,517,443 | B1 | 2/2003 | Villella | |
| 6,722,721 | B2 * | 4/2004 | Sherrer et al. | 296/61 |
| 6,971,317 | B2 * | 12/2005 | McKoy | 104/72 |

(Continued)

FOREIGN PATENT DOCUMENTS

| | | |
|---|---|---|
| GB | 1438755 | * 6/1976 |
| GB | 1599897 | * 10/1981 |

OTHER PUBLICATIONS

Photo 1, Finding Nemo Submarine Voyage Attraction, Disneyland, Anaheim, California, 1 page, at least as early as Sep. 16, 2008.

(Continued)

*Primary Examiner* — Mark Le

(74) *Attorney, Agent, or Firm* — Dorsey & Whitney LLP

(57) ABSTRACT

A curved wheelchair ramp for ride vehicles of an amusement park attraction, ride, or other environment is provided. In one embodiment, the wheelchair ramp is maneuverable between a retracted position and an extended position. In the retracted position, the wheelchair ramp may form a door to the ride vehicle. In the extended position, the wheelchair ramp extends, in a curve, between an access opening of the ride vehicle to a station platform. In various embodiments, the ramp may have a first segment, a second segment, and a third segment. The segments may fold together or may nest together.

9 Claims, 10 Drawing Sheets

(56) References Cited

U.S. PATENT DOCUMENTS

| | | | | |
|---|---|---|---|---|
| 7,082,637 | B1 * | 8/2006 | Griffin | 14/69.5 |
| 2009/0095189 | A1 * | 4/2009 | Roop | 104/29 |

OTHER PUBLICATIONS

Photo 2, Finding Nemo Submarine Voyage Attraction, Disneyland, Anaheim, California, 1 page, at least as early as Sep. 16, 2008.
Photo 3, Finding Nemo Submarine Voyage Attraction, Disneyland, Anaheim, California, 1 page, at least as early as Sep. 16, 2008.
Photo 4, Finding Nemo Submarine Voyage Attraction, Disneyland, Anaheim, California, 1 page, at least as early as Sep. 16, 2008.
Photo 5, Finding Nemo Submarine Voyage Attraction, Disneyland, Anaheim, California, 1 page, at least as early as Sep. 16, 2008.
Photo 6, Jungle Cruise Attraction, Disneyland, Anaheim, California, 1 page, at least as early as Sep. 16, 2008.
Photo 7, Jungle Cruise Attraction, Disneyland, Anaheim, California, 1 page, at least as early as Sep. 16, 2008.
Photo 8, Jungle Cruise Attraction, Disneyland, Anaheim, California, 1 page, at least as early as Sep. 16, 2008.
Photo 9, Jungle Cruise Attraction, Disneyland, Anaheim, California, 1 page, at least as early as Sep. 16, 2008.
Photo 10, Jungle Cruise Attraction, Disneyland, Anaheim, California, 1 page, at least as early as Sep. 16, 2008.
Photo 11, Jungle Cruise Attraction, Disneyland, Anaheim, California, 1 page, at least as early as Sep. 16, 2008.
Photo 12, Jungle Cruise Attraction, Disney's California Adventure, Anaheim, California, 1 page, at least as early as Sep. 16, 2008.
Kali River Turntable, showing turntable for ride entry/exit, Mar. 7, 2008, submitted on CD-ROM.

* cited by examiner

WHEELCHAIR RAMP FOR A RIDE VEHICLE

FIELD OF THE INVENTION

The present invention relates to a wheelchair ramp for ride vehicles. More particularly, the present invention relates to a curved wheelchair ramp for ride vehicles.

BACKGROUND

Some amusement park attractions or rides have ride dynamics that are favorable for ride participation in a wheelchair. In order for a wheelchair user to use the ride, they must access and enter a ride vehicle or transfer into a seat. One solution is to provide a ramp between the station platform and the ride vehicle. The ramp addresses requirements of providing a constant surface between the station platform and the ride vehicle as well as moving the wheelchair across a height differential between the station platform and the ride vehicle. For ride vehicles using a ramp, it is convenient that the ramp be attached to the vehicle and travel with it such that when the vehicle returns to the station, the ramp can be tilted down and the wheel chair rolled off of the vehicle. Generally, ramp angles of 1:8 (i.e., a one inch difference in height for every eight inches of length) are not exceeded. Thus, the greater the elevation change between the station platform and the floor of the ride vehicle, the longer the ramp must be. At some point, the ramp may have a length such that it extends a relatively long distance on a station platform and impairs other passenger access to other ride vehicles. This can lead to congestion on the platform and ultimately require stopping the ride to permit passenger exit and entrance onto the ride. Such stopping may impair optimal performance of the ride.

There is a need for a wheelchair ramp for amusement park attractions that enhances user experience by minimizing platform congestion due to extension onto the station platform.

SUMMARY

A wheelchair ramp for ride vehicles is provided. More particularly, a curved wheelchair ramp for ride vehicles of an amusement park attraction, ride, or other environment is provided.

In one example a wheelchair accessible ride vehicle is provided, and includes a wheelchair ramp having a length including a lateral displacement extending at least partially from one end of the length to an opposite end of the length, wherein the lateral displacement may form a curve. The wheelchair accessible ride vehicle has an access opening and the wheelchair ramp extends from the access opening to a station platform.

In another example, a wheelchair ramp for a ride vehicle is provided, and includes a first segment and a second segment. The wheelchair ramp is maneuverable between a retracted position and an extended position. In the retracted position, the wheelchair ramp forms a door for the vehicle.

In yet another example, a wheelchair ramp for a vehicle is provided and includes more than one segment, the segments extending in a curved direction away from the ride vehicle when extended. When retracted, the segments nest together. A recess is provided at a bottom position on the ride vehicle. In the nested configuration, the wheelchair ramp may be stowed in the recess.

Other features and advantages of the present invention will become apparent from the following detailed description, taken in conjunction with the accompanying drawings, which illustrate, by way of example, the principles of the invention.

DETAILED DESCRIPTION

Figure 1:
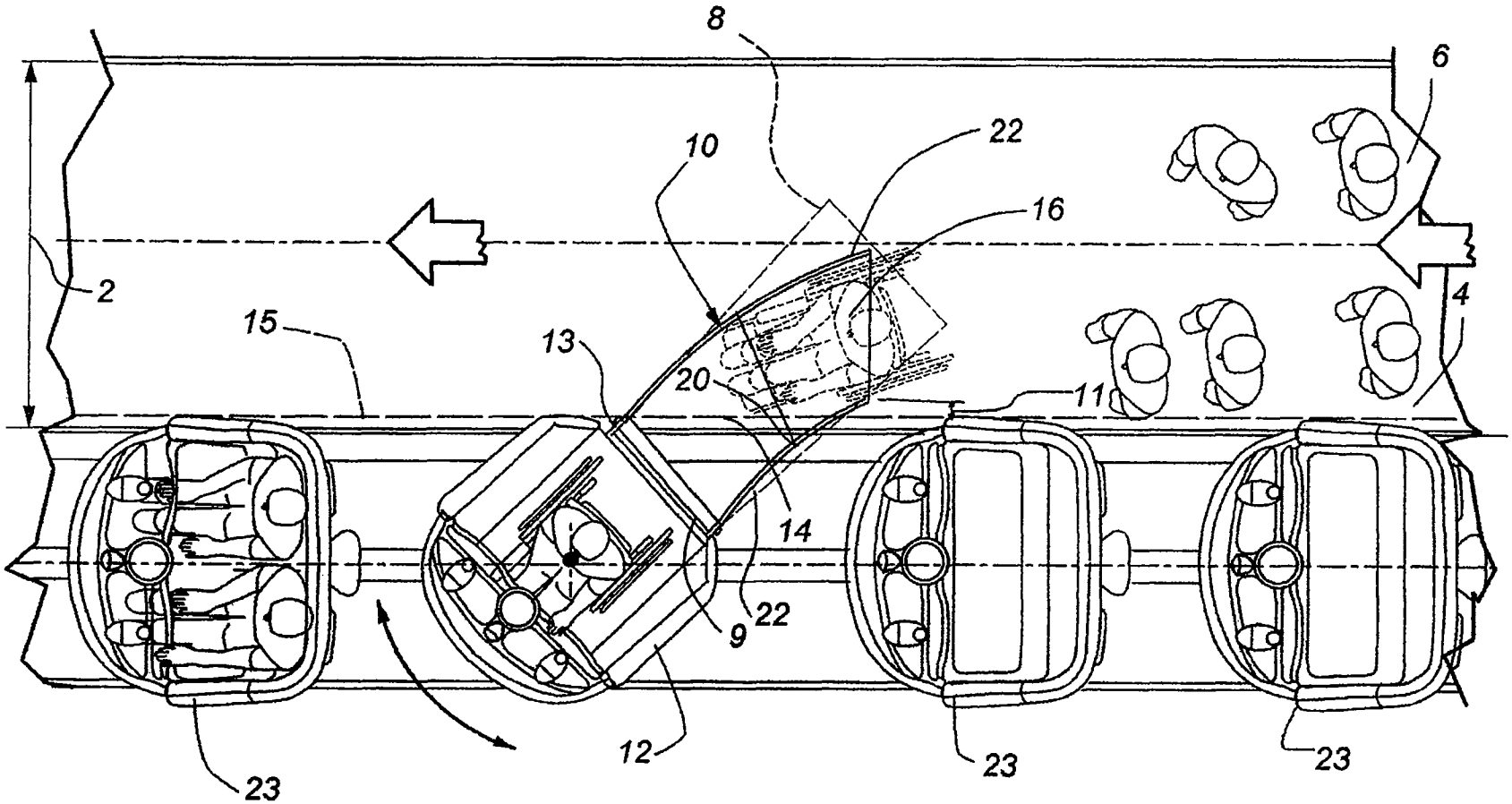
FIG. 1 illustrates a top view of a portion of a ride including a wheelchair access vehicle having a bi-fold ramp, with the ramp being in a down, or extended, position, in accordance with one example.

A wheelchair ramp for ride vehicles is provided. More particularly, a curved (for example, helical or spiral) wheelchair ramp for ride vehicles of an amusement park attraction, ride, or other application is provided. In some embodiments, ramps as described herein may be used for amusement park attractions or rides wherein ride dynamics are favorable for ride participation in a wheelchair. Thus, the wheelchair user may remain in the wheelchair during the ride. It is to be appreciated that, in other embodiments, ramps as described herein may be provided where the wheelchair user accesses the vehicle using a wheelchair ramp but is transferred from a wheelchair into a vehicle seat for the ride (with the wheelchair being returned to a station platform during the ride). Further, ramps as provided herein may be used for accessing any suitable vehicle, including, for example, a transportation vehicle.

Amusement park rides typically have a station platform on which passengers of the ride are grouped and organized in order to board the ride vehicles. Frequently, a station platform has two lanes: a first lane (or "access lane") along which passengers travel to access and board a particular vehicle and a second lane (or "boarding lane"), closer to the ride vehicles, from which passengers board the vehicle. With some amusement park rides, it may be useful to facilitate boarding of wheelchair users in the direction of travel of the ride. Orientation of the wheelchair user in the direction of travel of the ride can reduce size of the ride vehicle because it is not necessary for the wheelchair user to significantly maneuver the wheelchair during or after boarding.

When providing a wheelchair ramp for access to a ride, considerations include the comfort and experience of the wheelchair user and also the experience of other passengers of the ride. A factor in wheelchair ramp design is the slope of the ramp. Generally, the lower the slope, the easier the ramp is for a wheelchair user to navigate. A lower slope, however, requires a longer ramp. In the context of amusement park attractions, the space available for a wheelchair ramp is limited. If the ramp extends straight, or linearly, from the ride vehicle, the ramp may extend through the boarding lane and into the access lane. This can lead to congestion on the station platform and may compromise the ability of passengers to travel on the access lane to their vehicle. Generally, the length of a curved or helical ramp may depend on the desired rise to run, typically 1 to 8, described below, and also on a desired cross slope, for example, no greater than approximately 2%.

Boarding and deboarding of ride vehicle systems may be done in many different manners. In some cases, the ride vehicles come to a complete stop in the station, passengers deboard, and new passengers board. In other cases, the ride vehicles may not come to a complete stop in the station. That is, they may continue traveling at a velocity while in the station. Typically, at least the boarding lane, and often the boarding lane and the access lane, are also moving and have a velocity (e.g. a moving sidewalk). The velocity of the boarding lane (and access lane, if moving) may be the same velocity as the ride vehicles while in the station such that there is substantially little or no relative movement between the boarding lane and the ride vehicle. With both the boarding lane and the ride vehicles moving, passengers having completed the ride must get off of the ride vehicle and passengers waiting to get on the ride must get on the ride vehicle all within a given distance and, thus, given time. Obstruction of the access lane can impact the ability of passengers to get off and get on the ride within the given time. Generally, embodiments provided herein may be used in ride vehicle systems wherein the ride vehicles come to a complete stop in the station or wherein they continue traveling at a velocity while in the station.

Wheelchair ramps as provided herein have a curvature such that extension of the ramp from the ride vehicle may be reduced without increasing the slope of the ramp. Thus, in accordance with some embodiments, the ramp has a length including a lateral displacement extending at least partially from one end of the length to an opposite end of the length. The lateral displacement may form a curve and the curve may, in some embodiments, be in three dimensions. Extension of the ramp to the station platform may be substantially in a horizontal manner, such as the "fan-like" extension in FIG. 9, or may be a combination of a horizontal and vertical manner, such as the combination unfolding and sliding ramp, shown, for example, in FIGS. 5*a*, 5*b*, and 6. In one embodiment, the ramp has a slope of 1:8, or a 1 inch difference in height for every eight inches in length. Accordingly, a slope and a length may be calculated. In alternative embodiments, the slope may be more or less than 1:8. In some embodiments, the length of the curved or helical ramp may depend on a cross slope, for example 2%. In some embodiments, curvature may be in two dimensions. In other embodiments, curvature may be in three dimensions. In some embodiments, the ramp may not extend at all into the access lane of the station platform. Generally, the ramp may be a helix (having a fixed radius or a changing radius) of less than one revolution (in one embodiment, the ramp comprises approximately ¼ revolution). In some embodiments, the ramp is relatively light-weight and may be handled and manipulated by a single person. In use, the ramp is lowered, the wheelchair is navigated up the ramp, and the ramp is manipulated for stowing and locked in place. For disembarking, the ramp is again lowered, the wheelchair is navigated down the ramp, and the ramp is manipulated for stowing and locked in place. The ramp may be accommodated in standard ride vehicles, and may be used in the station for normal loading and unloading of the attraction, or may be used out of the station in the event of an evacuation.

In some embodiments, a ramp as provided herein reduces the size of the ride vehicle, reduces the size of the station platform, and/or reduces the space between ride vehicles. More specifically, because the wheelchair user may access the wheelchair accessible vehicle in the direction of travel of the wheelchair accessible vehicle, the vehicle may have reduced maneuvering room inside. Alternatively, no maneuvering room may be provided. Further, in some embodiments, for example where the vehicle rotates and includes a curved ramp, the spacing between vehicles may be reduced. The wheelchair accessible vehicle (referred to herein as "the WAV") may have any suitable shape. For example, the WAV may have an off center body shape (relative to the ride track), a curved body shape, or other. In some embodiments, extension of the WAV towards the station platform is approximately the same as extension of other non-wheelchair accessible vehicles of the ride. Thus, the profile of the WAV may not present a different clearance envelop in the station which could interfere with operators or guests preparing to board.

In accordance with the embodiments shown, the boarding scenario may be forward on and forward off. More specifically, a wheelchair user may navigate the ramp in the forward direction and directly be in position for the ride. To disembark, the wheelchair user executes a 180° degree turn and navigates off the ramp in the forward direction to access the ride platform. The 180° degree turn may be achieved by maneuvering the wheelchair in the ride space or may be achieved by a turntable on the ride vehicle. In other embodiments, the ride may be forward on and backward off, backward on and forward off, or other. As discussed, the wheelchair accessible vehicle thus may have a reduced space by not requiring maneuvering room.

The ramp may be manufactured of any suitable material. In some embodiments, the ramp may be manufactured from aluminum. Aluminum is resistant to corrosion, is strong, and is lightweight. In some embodiments, aluminum with a texturized finish may be used to enhance grip of wheelchair tires with the ramp. In alternative embodiments, other materials may be used. For example, reinforced plastic, fiberglass, composite, or galvanized steel chemically coated with zinc may be used.

Figure 2:
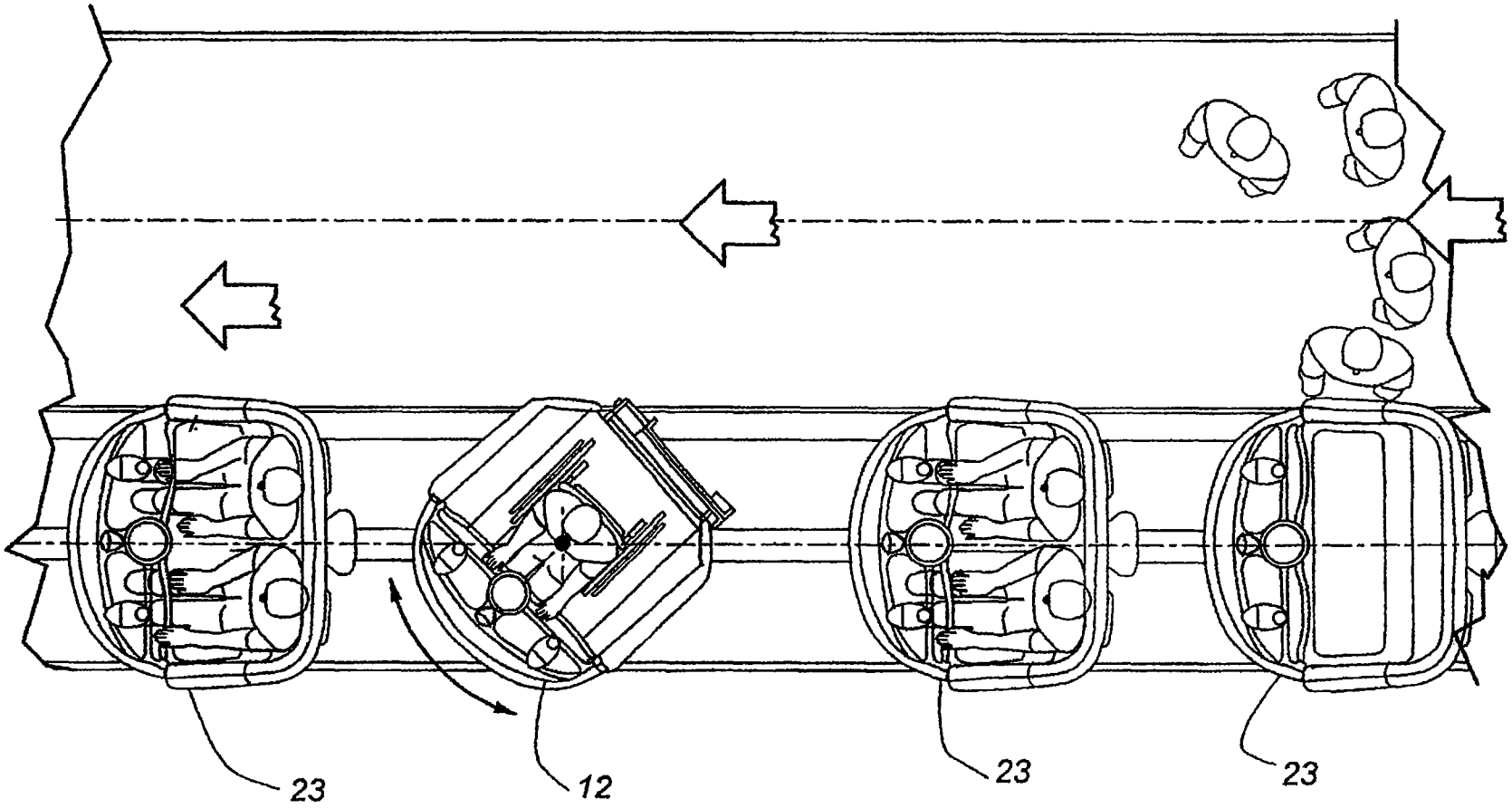
FIG. 2 illustrates a top view of the ride of FIG. 1 with the ramp of the wheelchair access vehicle being in an up, or retracted, position, and the ride vehicle in a position ready for extending the ramp.

FIGS. 1 and 2 illustrate a first embodiment of a wheelchair ramp 10 provided on a WAV 12 of an amusement park attraction, for accessing the WAV 12. In the embodiment shown, the WAV 12 is one of a plurality of vehicles of the ride. The vehicles may be entrained to move along a rail system or a continuous chain of vehicles. One or more of the vehicles, such as the WAV 12 may be selectably pivotable on the system to allow for loading or unloading of the WAV 12.

The WAV may be provided with a wall defining an interior space, a floor, and a grab bar or hand rail. The ride vehicle 12 has an access opening for entry into the ride vehicle. In the embodiment shown, the access opening is a rear access with the wheelchair ramp extending in a curve from the rear access to a station platform 2. Accordingly, in some embodiments, the WAV has a direction of movement and the access opening is at a portion of the WAV opposite the direction of movement. In alternative embodiments, the wheelchair ramp may extend from a side access of the WAV or from a front access of the WAV. One or more companion seats may be provided in a position such that a companion may accompany a wheelchair user in a WAV, generally such that the wheelchair user and companion sit shoulder to shoulder. Accordingly, the access opening and ramp door may be positioned such that it is offset or may be configured with an increased or decreased width such that the access opening and ramp door do not block access to the companion seat. When a companion seat is provided, such seat may be configured as is known in the art such as a fixed seat or a fold down seat. FIGS. 1 and 2 further illustrate standard ride vehicles 23.

In one embodiment, the ramp 10 may be provided as a door to a ride vehicle 12. Thus, in the "up position," also referred to as the "retracted position," the ramp 10 forms a door or containment barrier for the vehicle 12. The ramp 10 may be locked in the retracted position. In the "down position," also referred to as the "extended position," the ramp 10 forms a wheelchair ramp for wheelchair access to the ride vehicle 12. The ramp may be tilted between the up and down positions. In another embodiment, shown in FIGS. 10 and 11, in the retracted position, the ramp may be stowed in a recess beneath the ride vehicle, in which case the ride vehicle may have a separate door structure. Maneuvering of the ramp 10 from the retracted position to the extended position and back, or from a stowed position to an extended position and back, may be done in an automated manner or may be done manually. Automation may be achieved using motor controls as known in the art.

FIG. 1 illustrates the ramp 10 of the WAV 12 in the extended position. FIG. 2 illustrates the ramp 10 of the WAV 12 in the retracted position. FIGS. 1 and 2 illustrate the station platform 2, including a boarding lane 4 and an access lane 6. A linear or straight extension 8 of a standard wheelchair ramp from the ride vehicle 12 is illustrated. This extension 8 shows the relative length of a standard wheelchair ramp through the boarding lane 4 and into the access lane 6. As can be appreciated, such extension impairs the ability of passengers in the access lane 6 to access vehicles forward of the wheelchair ramp vehicle 12.

The ramp 10, shown in FIGS. 1 and 2, has a curvature such that it remains substantially in the boarding lane 4. Accordingly, in the extended position, the ramp 10 extends into the boarding lane 4 but does not extend substantially into the access lane 6. As shown, the ride vehicle 12 is rotated (in the embodiment shown, rotation is approximately 45°) such that the rear of the ride vehicle is oriented towards the station platform 2. Thus, the main body of the WAV may be rotated laterally relative to the station platform for extension of the ramp to the station platform. Such rotation may be to any suitable degree, for example 45° or 90°. The ramp 10 may then be folded down, or extended, described more fully below, to enable access from the station platform 2 to the interior of the WAV 12. In the embodiment shown, the amount of rotation of the WAV 12 and the curvature of the ramp 10 cooperate to provide a space 11 between the ramp 10 and the immediately following vehicle. This space 11 is a clearance space. Also as shown, in the rotated position, the outer perimeter and exterior shape of the WAV 12 is substantially in line with the outer perimeter of standard (and unrotated) ride vehicles 23, shown by dashed line 15. In some embodiments, the outer perimeter of the WAV 12 may extend past the outer perimeter of standard ride vehicles 23 so long as the WAV 12 does not extend substantially into the boarding lane 4 and interfere with user's motion in the access lane 6, or a loading assistant walking adjacent to the vehicles.

The ramp 10 comprises first and second segments 14 and 16. In this embodiment, the ramp 10 is a bi-fold ramp. In other embodiments, the ramp may have three segments (shown in FIGS. 5-8, 10, and 11). As is described, the segments may be moved relative to one another to maneuver between a retracted ramp position and an extended ramp position.

As shown in FIG. 1, the curvature of the first segment 14 and the second segment 16 is substantially the same. In alternative embodiments, the curvature may vary between segments. The first segment 14 and the second segment 16 are curved, with the inner (facing the ride) extension of the segments 14, 16 having a length less than the outer (facing the platform) extension of the segments 14, 16. In some embodiments, the second segment 16 may have a smaller width than the first segment 14 to permit nesting of the segments 14, 16. In one embodiment, the ramp 10 has a width of at least approximately 32 inches. In alternative embodiments, the ramp 10 may have other widths.

One embodiment of a bi-fold ramp 10 folds back to back. The ramp 10 is pivotally attached to the WAV 12 at pivot 18 in FIG. 6. As the ramp 10 is folded up at the pivot 18, the intermediate hinge 20 collapses the first and second segments 14 and 16 such that the bottom side of the first segment 14 faces the bottom side of the second segment 16. When unfolded, the first segment 14 and the second segment 16 engage one another to inhibit any relative movement past extending in a plane. In an alternative embodiment, the first and second segments 14 and 16 may fold face to face at the intermediate hinge 20. When folded face to face, segment 16 is folded first onto segment 14 and then the combination is folded up to WAV 12 about pivot 18. As shown, the ramp 10 may form a closure to the access opening to the ride vehicle 12.

Each longitudinal edge of the ramp 10 may be provided with a side kick plate 22. The side kick plate 22 (also shown in FIG. 7*b*) is a raised edge and provides guidance to the wheelchair user as the wheelchair is pushed up or down the ramp 10. Surface treatment for enhanced friction or laterally extending friction strips may be provided on the ramp 10 to further enhance stability of a wheelchair on the ramp 10, as is known in the art. In various embodiments, separate tracks may be provided, additionally or alternatively, to the ramp to support the wheelchair user as the wheelchair user is pushed up or down the ramp.

The ramp 10 has an edge 9 closest to the WAV 12. Generally, the ramp 10 may be configured such that, in the extended position, the surface of the ramp at the edge 9 of the WAV 12 is of approximately equal height with the floor of the WAV 12.

Further, the ramp 10 may be configured such that little or no spacing exists between the edge 9 of the ramp 10 and the edge of the WAV 12 at the access opening. If there is a height difference between the height of the ramp 10 at the edge 9 and the height of the floor or if there is a significant gap between the edge 9 of the ramp 10 and the edge of the WAV 12 at the access opening, a bridge may be provided between the ramp 10 and the WAV 12.

During operation, the boarding lane 4 and the access lane 6 may be moving walkways. Thus, the ride vehicles 12, 23 may approach the station platform 2 at a speed approximating that of the boarding lane 4 and the access lane 6 such that relative speed between the station platform 2 and the vehicles 12, 23 is low but the vehicles 12, 23 do not stop (such as in a moving continuous chain of connected vehicles wherein the speed remains substantially unchanged in the station). As the WAV 12 approaches, the WAV 12 is rotated, the ramp 10 is lowered and unfolded to the down position, (shown in FIG. 1), and a wheelchair user exits into the boarding lane 4 and maneuvers to the access lane 6 to exit the platform. Once the wheelchair user exits the WAV 12, a new wheelchair user enters, and the ramp 10 is folded and raised to the retracted position. Movement of the ramp 10 between the retracted position and the extended position may be automated or may be manual. The ride may be continuously operated during unloading and loading of the vehicles, including the WAV 12. More specifically, the ride vehicles may continue at a speed more than zero mph during loading and unloading.

In some embodiments, a flag or other notification may be provided at the appropriate position on the station platform 2 to indicate that vehicles at that position are wheelchair accessible vehicles.

Figure 3:
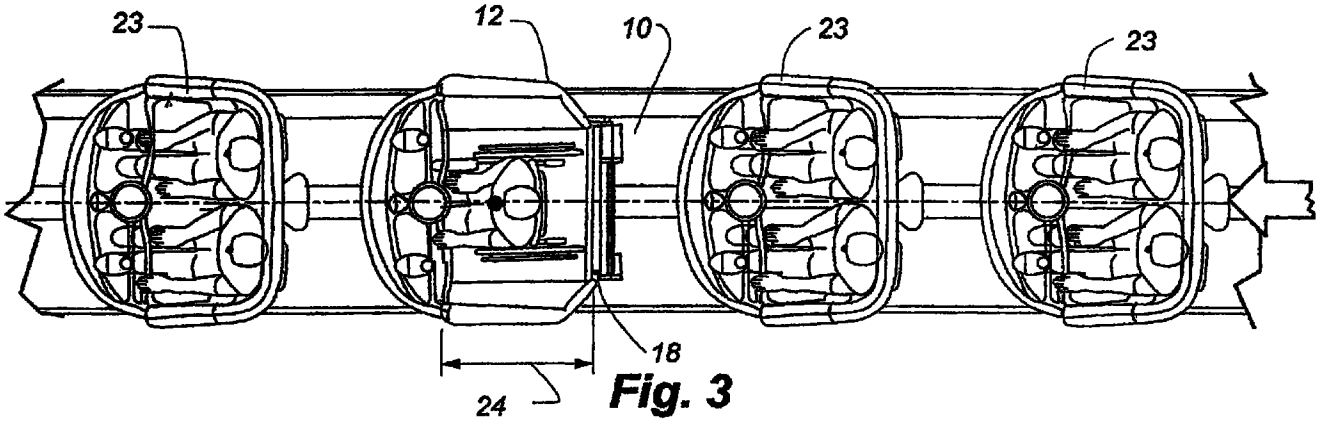
FIG. 3 illustrates a top view of the ride of FIG. 1 with the wheelchair access vehicle oriented for ride operation.
Figure 4:
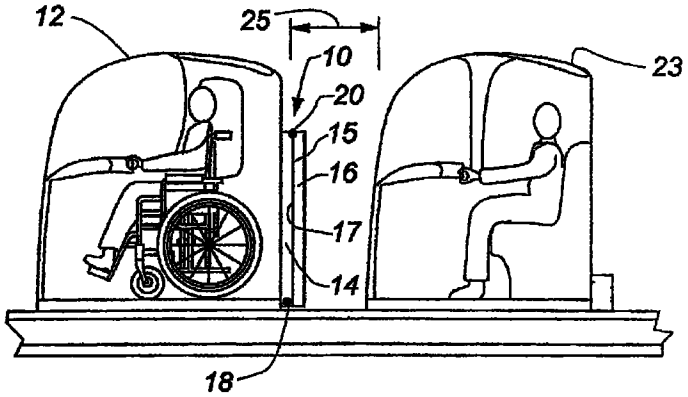
FIG. 4 illustrates a schematic side view of a wheelchair user in the wheelchair access vehicle of FIG. 1 and an ambulatory user in a standard ride vehicle, with the ramp of the wheelchair access vehicle being in a retracted position.

FIGS. 3 and 4 illustrate the embodiment of FIGS. 1 and 2, with the ramp 10 in the retracted position and the WAV 12 oriented for ride operation. In the embodiment of FIG. 3, the wheelchair is on board, the wheelchair is secured (e.g., the brake is set), the ramp is retracted and locked in place, and the WAV is oriented in the ride direction. As shown, the WAV 12 is in line with other ride vehicles 23. The WAV 12 is somewhat larger than other ride vehicles 23. The size difference between the WAV 12 and the other ride vehicles 23 is in the interior ride vehicle space 24 of the vehicle. More specifically, the space 24 of the WAV 12 may in some embodiments be sufficient to provide for wheelchair maneuverability. For example, where it is envisioned that the wheelchair may be maneuvered or rotated in the WAV, a 60 inch maneuvering curve (i.e., 60 inch diameter space) may be provided. Where the wheelchair is not maneuvered in the WAV, for example, in a WAV where access is forward on and reverse off, a parking space such as, for example 30 inches by 48 inches may be provided. Thus, in some embodiments, no maneuvering space may be provided. The ramp 10 does not significantly contribute to size differential between the WAV 12 and standard ride vehicles 23. Accordingly, in embodiments wherein a standard ride vehicle has sufficient interior ride vehicle space to accommodate a wheelchair, a vehicle with a wheelchair ramp as provided herein is of substantially the same size as a standard ride vehicle.

FIG. 4 illustrates the retracted position of the ramp 10. Pivot 18 is provided at a bottom portion of the rear of the vehicle 12. At the pivot 18, the first segment 14 of the ramp 10 folds upwardly and towards the rear of the vehicle 12. The intermediate hinge 20 is thus at an upper position with the second segment 16 extending downwardly therefrom. The bottom side 15 of the first segment 14 thus faces the bottom side 17 of the second segment 16. A lock or coupling mechanism may be provided to substantially lock the ramp 10 in the retracted position shown in FIG. 4. In the retracted position, the ramp 10 operates to enclose the interior space of the WAV 12. Movement of the ramp 10 from the retracted position to the extended position operates to open the WAV 12, similar to opening of a door of a vehicle.

FIGS. 2 and 4 illustrate the ramp 10 in the retracted position. As shown, the ramp 10 does not intrude on the spacing 25 (see FIG. 4) between the WAV 12 and immediately following vehicle 23 at a top portion of the WAV 12. Further, in the retracted position, the ramp 10 is substantially adjacent the rear of the WAV 12. This positioning reduces extension of the ramp 10 into the spacing 25 between the WAV 12 and the vehicle 23. The spacing 25 provides clearance for pitch and or yaw of the vehicles. More specifically, the spacing 25 permits some tilting of the WAV 12 and vehicle 23 towards one another without contact occurring between the vehicles 12, 23. In alternative embodiments, the spacing 25 may be varied. Further, the ramp 10 may not be substantially adjacent the rear of the WAV 12. The ramp 10 may be built in to contoured side of WAV 12 to enhance appearance and clearance of the WAV 12.

Figure 5A:
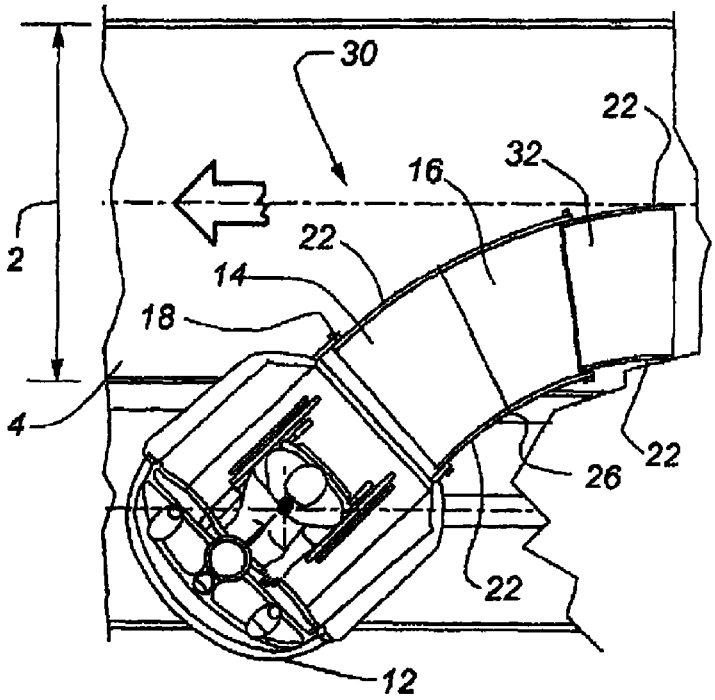
FIG. 5*a* illustrates a top view of a wheelchair access vehicle having a three segment ramp, with the ramp being in an extended position, in accordance with one example.
Figure 5B:
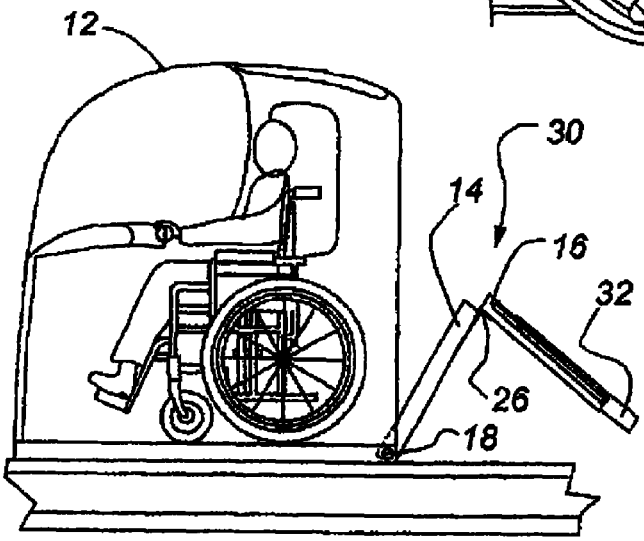
FIG. 5*b* illustrates a top view of the three segment ramp of FIG. 5*a* in an intermediate position, in accordance with one example.
Figure 6:
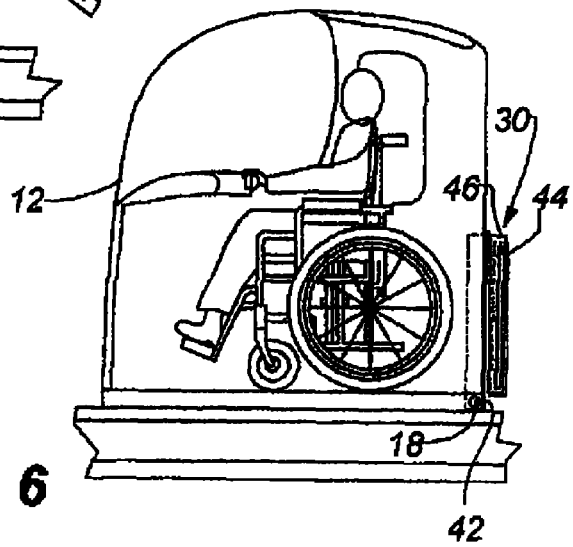
FIG. 6 illustrates a schematic side view of a wheelchair user in the wheelchair access vehicle of FIG. 5, with the ramp of the wheelchair access vehicle being in a retracted position.

FIGS. 5*a*-8 illustrate three segment embodiments of the wheelchair ramp. In the embodiment of FIGS. 5*a*, 5*b*, and 6, the ramp has a curvature and includes three segments with the first and second segments collapsing with a folding mechanism there between and the third segment collapsing with a sliding mechanism. In the embodiment of FIGS. 7*a*-7*c* and 8, the ramp has a curvature and includes three segments, all collapsing together with a sliding mechanism, as explained in more detail below As shown in FIGS. 5*a*, 5*b*, and 6, one embodiment of a curved three segment ramp 30 includes a first segment 14, a second segment 16, and a third segment 32. FIG. 5*a* illustrates the ramp 30 in an extended position. FIG. 5*b* illustrates the ramp 30 in an intermediate position with the third segment 32 nested with the second segment 16. FIG. 6 illustrates the ramp 30 in a retracted position. The ramp 30 may be locked in the retracted position. The ramp 30 in the retracted configuration may be adjacent a wall of the WAV 12, may conform to an exterior configuration of the WAV 12, or may form a wall or door of WAV 12. As shown, the first segment 14 and the second segment 16 have substantially the same widths while the third segment 32 has a width suitable for nesting with the second segment 16. The first segment 14, second segment 16, and third segment 32 may have the same curvature, as shown, or may have varying curvatures. The first segment 14 and the second segment 16 operate with respect to the WAV 12 and one another substantially as described with respect to FIGS. 1-4. More specifically, a pivot 18 is provided near the rear of the WAV 12 and an intermediate hinge 20 is provided between the first segment 14 and the second segment 16. To collapse the three segment ramp 30, the third segment 32 slides into a nesting position with the second segment 16. In the embodiment shown, the third segment 32 slides along the top of the second segment 16. In alternative embodiments, the third segment 32 may slide along the bottom of the second segment 16. The second segment 16 folds at the intermediate hinge 20 with the first segment 14. The intermediate hinge 20 may be oriented such that the bottom surfaces of the first segment 14 and second segment 16 face one another when folded or may be oriented such that the top surfaces of the first segment 14 and second segment 16 face one another when folded. The first segment then folds at the pivot 18 to be adjacent to the WAV 12. Side kick plates 22 may be provided along each of the first, second, and third segments 14, 16, and 32.

As may be appreciated, in embodiments wherein one segment nests on another segment, a sliding mechanism may be provided to facilitate sliding of the nesting segment, segment 32 in FIG. 5*a*, onto the receiving segment, segment 16 of FIG. 5*a*. The sliding mechanism may be, for example, a pin and slot structure. In one embodiment, slots are provided along sidewalls of segment 16 for receiving pins provided in complimentary position on segment 32. The slots thus may be provided on an upper surface of segment 16 and the pins may be provided extending from a lower surface of segment 32. The pins of segment 32 slide in the slots of segment 16 to facilitate segment 32 nesting with segment 16.

Figure 7A:
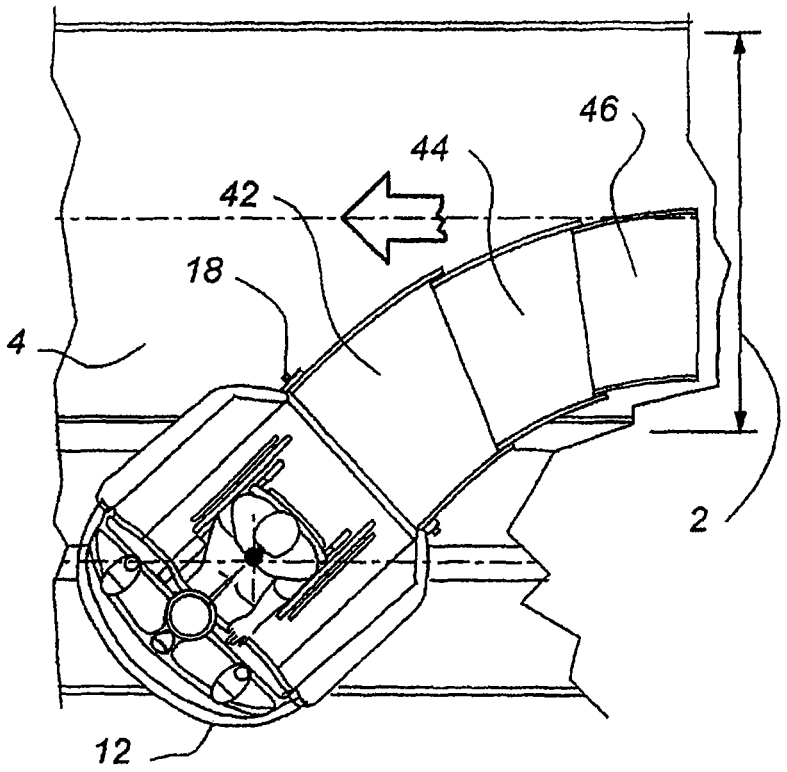
FIG. 7*a* illustrates a top view of a wheelchair access vehicle having a three segment ramp, with the ramp being in an extended position, in accordance with another example.
Figure 7B:
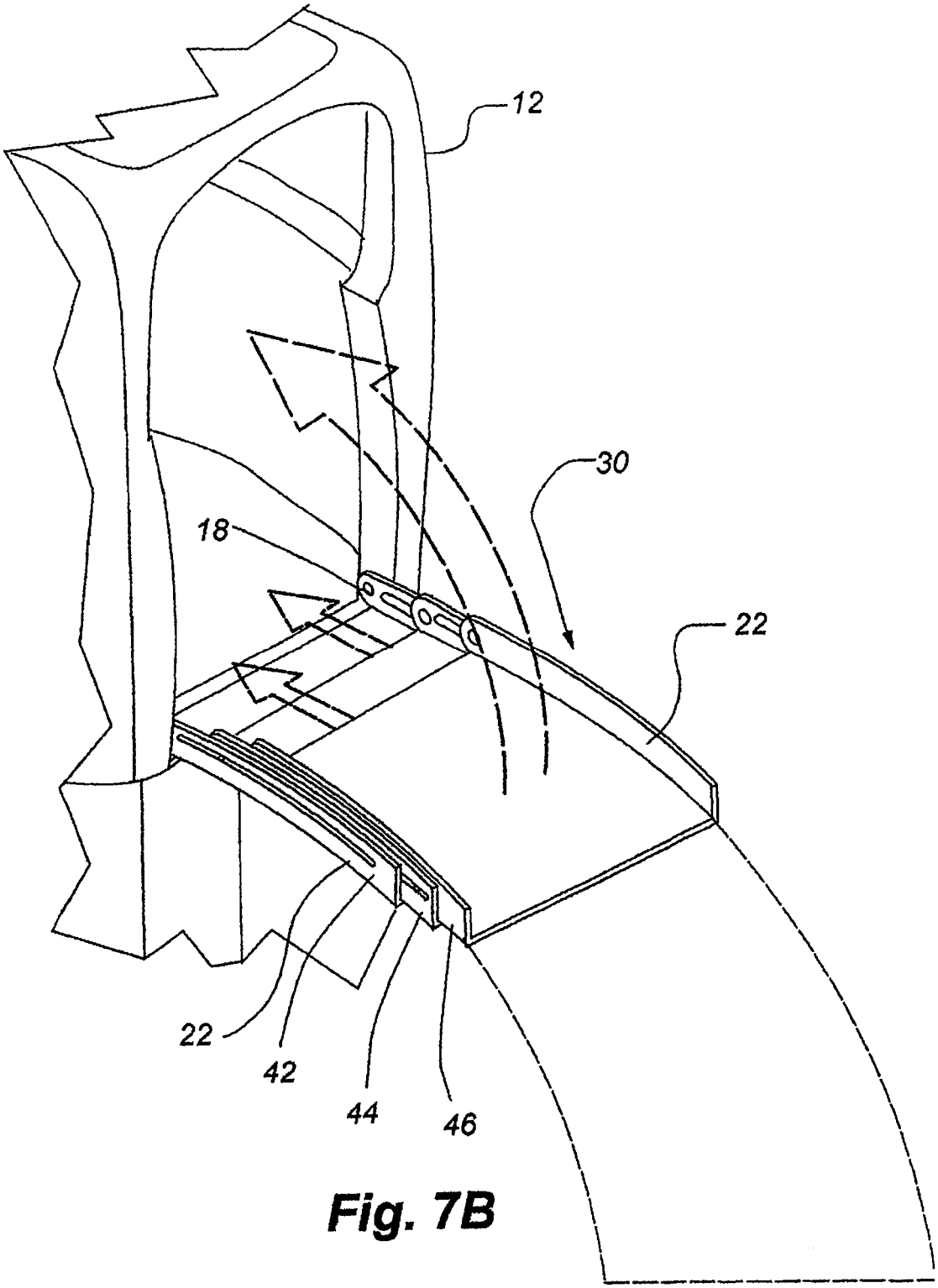
FIG. 7*b* illustrates an isometric view of the three segment ramp of FIG. 7*a* in an intermediate position, in accordance with one example.
Figure 7C:
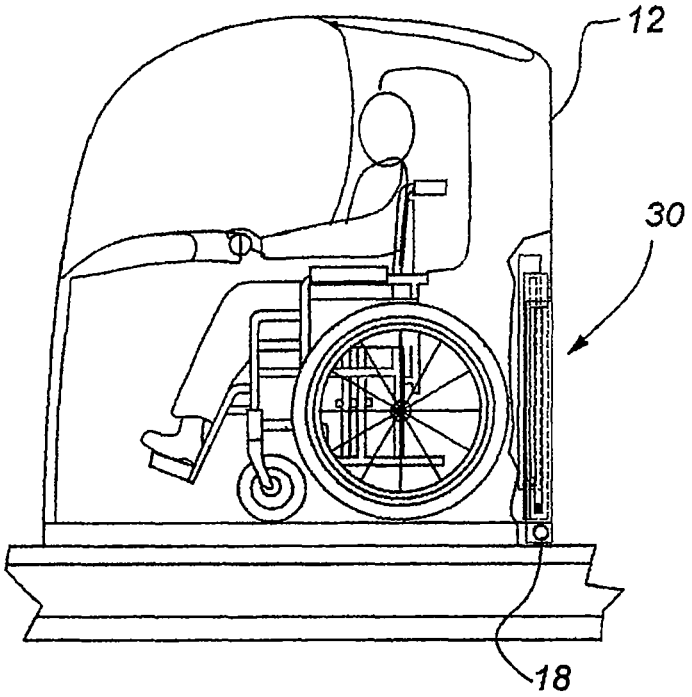
FIG. 7*c* illustrates a side view of the three segment ramp of FIG. 7*a* in a retracted position, in accordance with one example.
Figure 8:
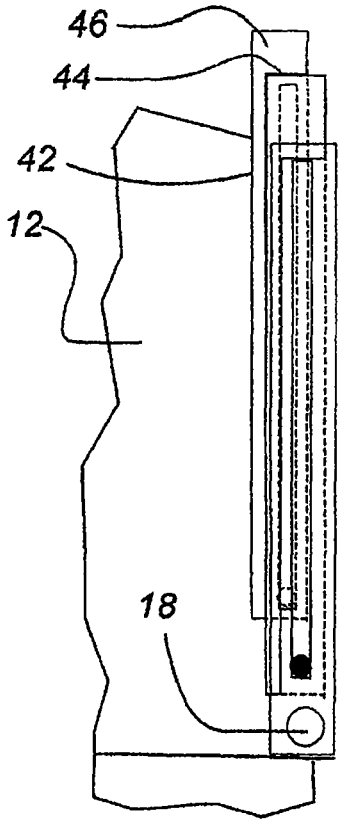
FIG. 8 illustrates a side view of the ramp of the wheelchair access vehicle of FIG. 7, with the ramp of the wheelchair access vehicle being in a retracted position.

A further embodiment of a three segment ramp 40 is shown in FIGS. 7*a*-7*c* and 8. In the embodiment shown, the ramp 40 comprises a first segment 42, a second segment 44, and a third segment 46. FIG. 7*a* illustrates the curved ramp 40 in an extended position and extending into the boarding lane 4 of the platform 2. FIG. 7*b* illustrates the curved ramp 40 in an intermediate position with the third segment 46 nested with the second segment 44 and the second segment 44 nested with the first segment 42. FIG. 7*c* illustrates the curved ramp 40 in a retracted position. The ramp 40 may be locked in the retracted position. FIG. 8 illustrates the ramp 40 in a retracted position and part of the WAV 12. Each segment has a slightly smaller width, suitable for nesting, than the preceding segment. The curvature of each segment may be substantially the same to enhance nesting of the segments. Thus, to collapse the three segment ramp 30, the third segment 46 slides into a nesting position with the second segment 44, the second segment 44 slides into a nesting position with the first segment 42, and the first segment 42 folds upwardly towards the rear of the WAV 12 at a pivot point 18.

Figure 9:
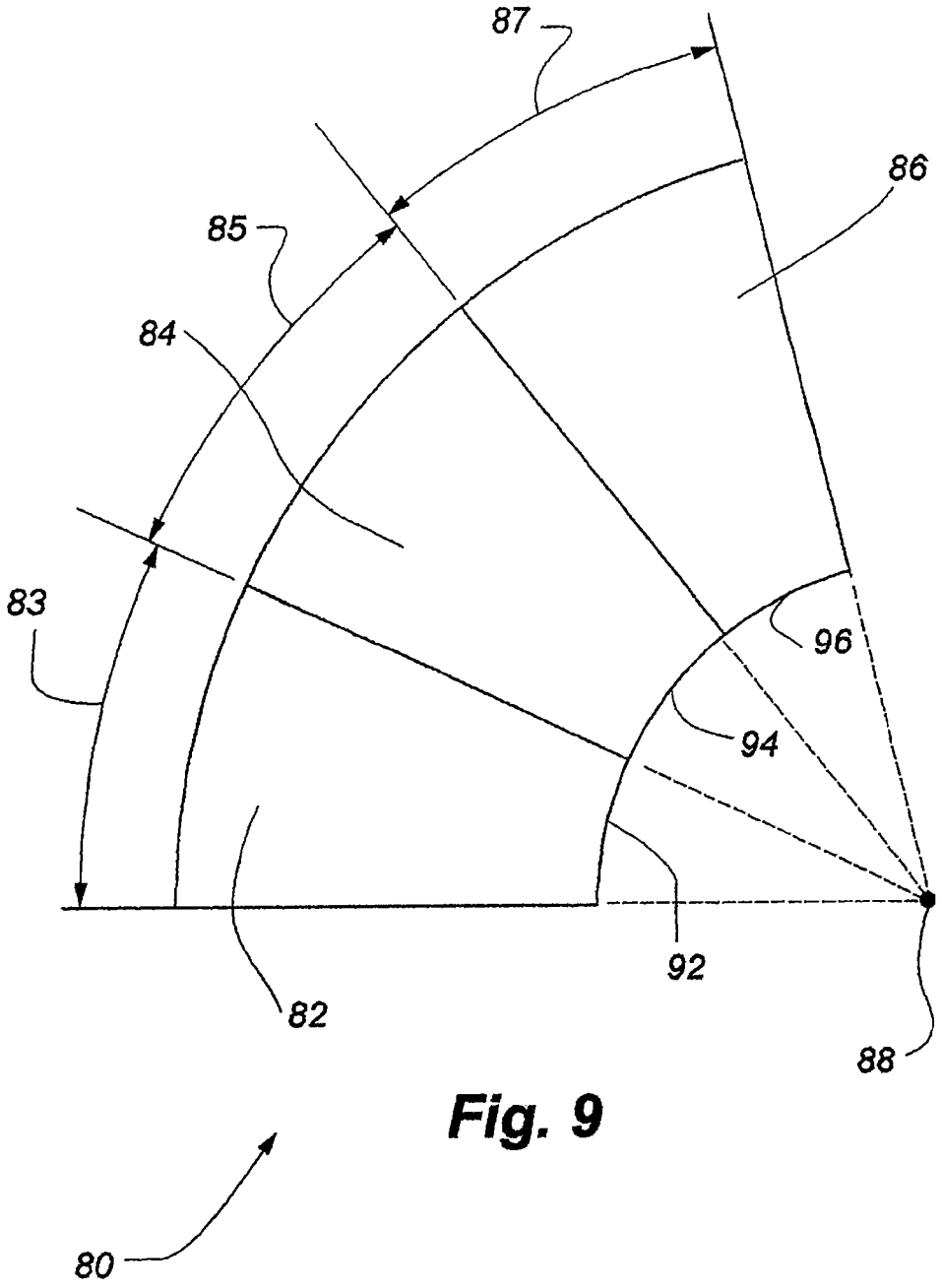
FIG. 9 illustrates a schematic illustration of a three segment ramp with rotation about a virtual pivot, in accordance with one example.

In the embodiments shown in FIGS. 5*a*-8, the ramp includes three segments. In certain embodiments, the segments may rotate about a virtual pivot, shown and described with respect to FIG. 9. As shown in FIG. 9, the three segments, 82, 84, and 86 have substantially the same arc and rotate about a virtual pivot. The first segment 82 has a circumferential extension 83, the second segment 84 has a circumferential extension 85, and the third segment 86 has a circumferential extension 87. The extensions 83, 85, 87 of each of the segments 82, 84, 86 are substantially the same. The edges 92, 94, 96 of the segments 82, 84, 86 are at substantially right angles to the tangent of the arc formed by those edges 92, 94, 96. The segments 82, 84, 86 thus rotate about a virtual pivot 88. As will be appreciated from the previous extension, the widths of the segments 82, 84, 86 may be sequentially smaller to permit nesting of the segments.

Figure 10:
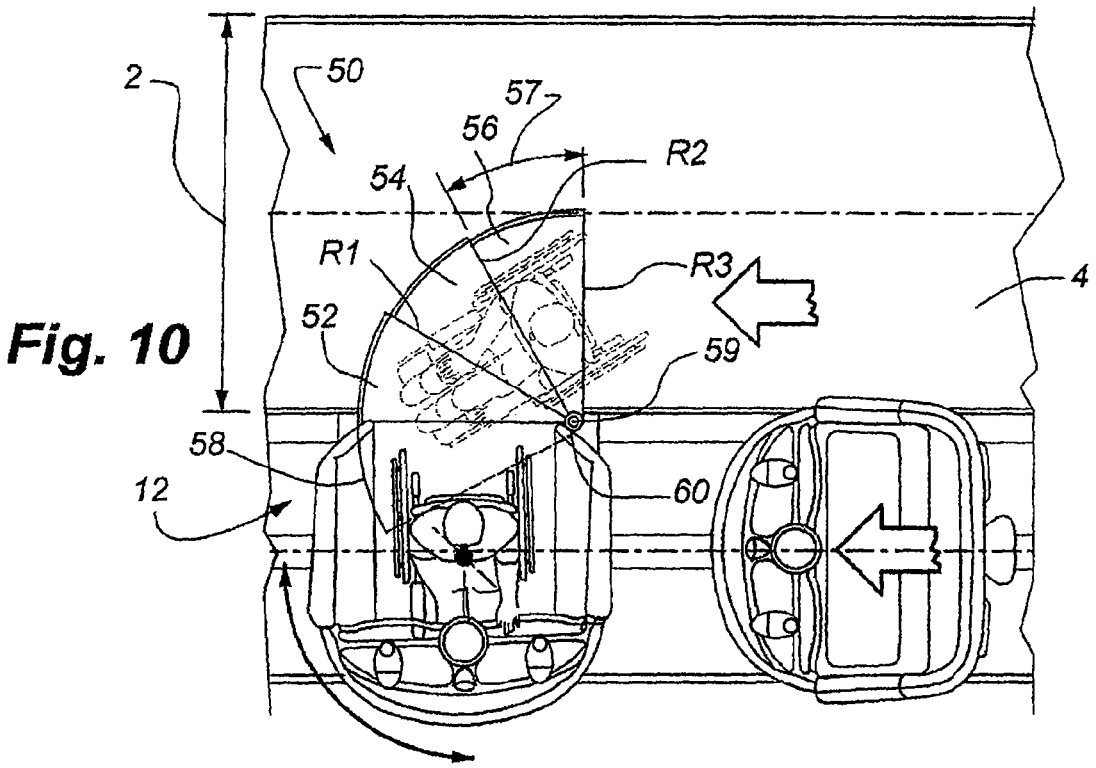
FIG. 10 illustrates a top view of a portion of a ride including a wheelchair access vehicle having a three segment ramp, with the ramp being in an extended position, in accordance with yet another example.
Figure 11:
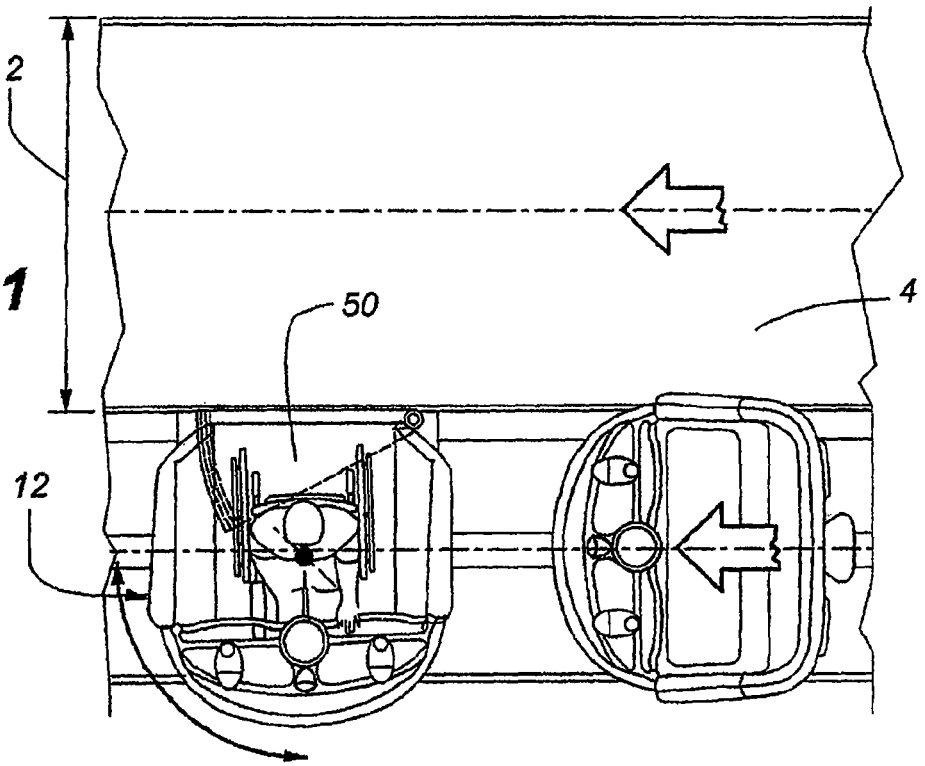
FIG. 11 illustrates a top view of the ride of FIG. 1 with the three segment ramp of the wheelchair access vehicle being in a stowed and locked position.

FIGS. 10 and 11 illustrate an embodiment of a curved wheelchair ramp 50 that expands radially outwardly, in a fan-like manner, from the WAV 12. FIG. 10 illustrates the ramp 50 in an extended configuration, extending into the boarding lane 4 of the platform 2. FIG. 11 illustrates the ramp 50 in a stowed position with the ramp 50 received by the WAV 12 under the floor of the WAV 12. The ramp 50 may be locked in the stowed position. In some embodiments where the ramp stows under the floor of the ramp of the WAV, a step may thereby be formed at the end of the ramp at the vehicle.

As shown, the ramp 50 includes first, second, and third segments 52, 54, 56. Each segment 52, 54, 56 has a pie shape with the circumferential side towards the station platform 2 having an arc length 57 and the end towards the ride forming a narrower portion, such as a point 59. Each segment has a slightly smaller width and radius R than the preceding segment to facilitate nesting of the segments. The first segment 52 has radius R1, the second segment 54 has radius R2, and the third segment 56 has radius R3, with R3 being smaller than R2 and R2 being smaller than R1. A recess 58 may be provided in the WAV 12 for receiving the ramp 50 in the stowed position. The segments 52, 54, 56 rotate about a pivot point 60. In the embodiment shown, the pivot point 60 is the point at which the segments 52, 54, and 56 meet. Thus, to collapse the three segment ramp 50, the third segment 56 rotates into a nesting position with the second segment 54, the second segment 54 rotates into a nesting position with the first segment 52, and the first segment 52 rotates into a stowed position to fit in recess 58 on the WAV 12.

To extend the ramp 50, the WAV 12 is rotated (in the embodiment shown, rotation is approximately 90°) such that the rear of the ride vehicle is oriented towards the station platform 2. The segments 52, 54, 56 of the ramp are expanded onto the boarding lane 4 of the station platform 2. Expansion of the segments 52, 54, 56 may be done manually or in an automated fashion (using appropriate motor controls). For manual extension of the segments 52, 54, 56, a handle may be provided extending from the ramp 50 when in a stowed position.

Figure 12:
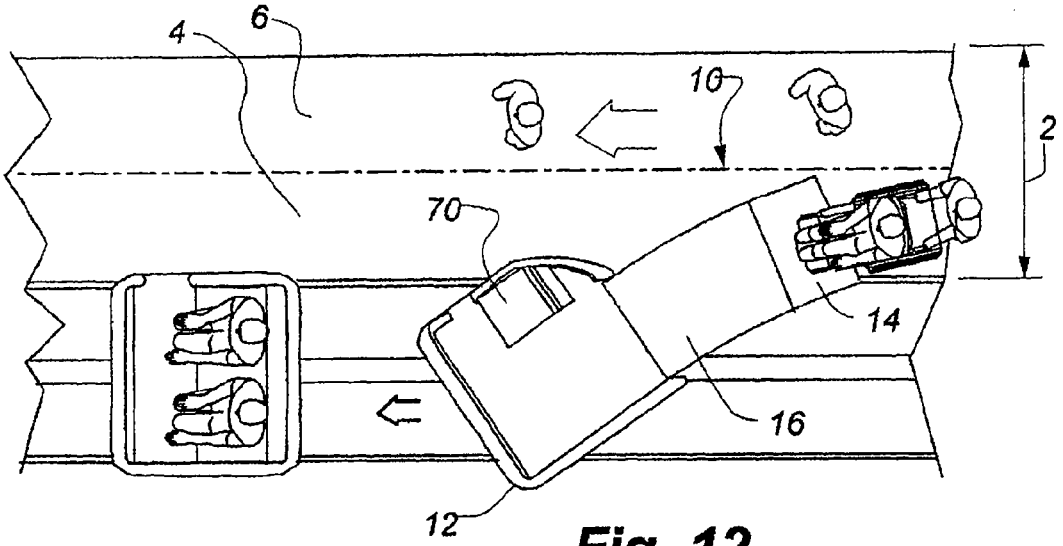
FIG. 12 illustrates a top view of a wheelchair access vehicle having a bi-fold ramp and a companion seat, with the ramp being in a down position and the wheelchair user approaching the ramp, in accordance with one example.
Figure 13:
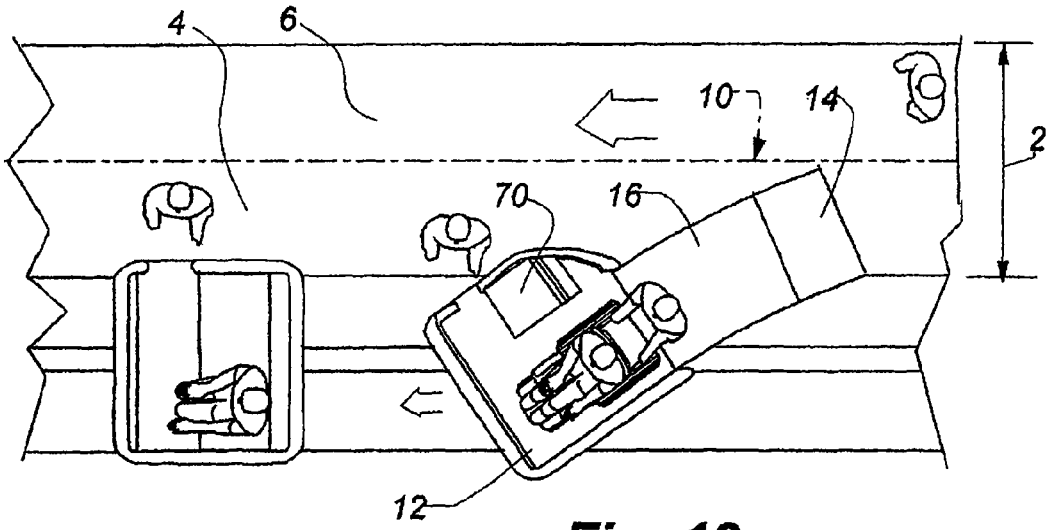
FIG. 13 illustrates a top view of the wheelchair access vehicle of FIG. 12 with the wheelchair user positioned in the vehicle.

An embodiment comprising a WAV including a companion seat is shown in FIGS. 12 and 13. As shown, the ride vehicle 12 has a companion seat 70. Generally, a companion seat 70 may be provided in any ride vehicle wherein such seat may be accommodated in the vehicle space. In one embodiment, a companion seat is provided where the vehicle width is greater than 44 inches and the wheelchair may be off-center. In the embodiment of FIGS. 12 and 13, the ramp 10 is substantially the same as the ramp of FIGS. 1-4 and comprises first and second segments 14, 16. FIG. 12 illustrates a wheelchair user and companion approaching the ramp 10 to access the WAV. FIG. 13 illustrates the wheelchair user in riding position in the WAV.

In alternative embodiments, the wheelchair ramp may be a single piece or may have more than three pieces. For example, in a single piece embodiment, the ramp may be provided as a single curved unit that, in the extended position, extends from the WAV to the boarding row 4 substantially as disclosed with respect to previous embodiments. In the retracted position, the single piece ramp may form a portion of the exterior wall of the WAV, for example, filling a complementary shaped curved access opening, or may be positioned substantially adjacent an exterior wall of the WAV. Further, the curve in the ramp may be a constant curve, a complex curve, or may be a curve with an increasing or decreasing radius. The curve may also be made by a combination of linear segments angled one to the next, or by alternating linear and curved segments.

Although examples of this invention have been described above with a certain degree of particularity, those skilled in the art could make numerous alterations to the disclosed embodiments without departing from the spirit or scope of the invention as described in the specification, drawings and claims. All directional references (e.g. upper, lower, upward, downward, left, right, leftward, rightward, top, bottom above, below, vertical, horizontal, clockwise, and counterclockwise) are used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, these joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing form the spirit of the invention as defined in the appended claims.

What is claimed is:

1. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and the curve has a curvature in three dimensions.

2. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and the main body has a direction of movement, and the user access opening is at a portion of the ride vehicle opposite the direction of movement.

3. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and the main body rotates laterally approximately 45° relative to the station platform for extension of the wheelchair ramp to the station platform.

4. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, the wheelchair ramp is maneuverable between a retracted position and an extended position, the wheelchair ramp comprises a first segment and a second segment that move relative to one another to maneuver between the retracted position and the extended position, and a curvature of the first segment and a curvature of the second segment are substantially the same.

5. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and the wheelchair ramp extends vertically from the user access opening to the station platform.

6. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and the wheelchair ramp extends horizontally from adjacent the user access opening to the station platform.

7. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp; and a companion seat;

wherein the vehicle is movable on a track, the wheelchair ramp is configured to extend to the station platform while the vehicle is moving on the track parallel to the station platform, and the main body is configured to rotate between a ride direction and a boarding direction while on the track.

8. A wheelchair accessible ride vehicle accessible from a station platform, said ride vehicle comprising:

a main body having a user access opening;

a wheelchair ramp operably associated with said main body, said ramp having a length and including a lateral displacement extending at least partially from one end of said length to an opposite end of said length, and extending from adjacent the user access opening to the station platform, wherein said lateral displacement is a curve along at least a portion of said length of said ramp;

wherein the vehicle is movable on a track, the wheelchair ramp is configured to extend to the station platform while the vehicle is moving on the track parallel to the station platform, the main body is configured to rotate between a ride direction and a boarding direction while on the track, and said wheelchair accessible ride vehicle is one of a plurality of ride vehicles movable on the track;

at least a second ride vehicle is positioned on said track adjacent said wheelchair accessible ride vehicle, said at least second ride vehicle including a main body defining a width relative to said track;

said main body of the wheelchair accessible ride vehicle having a width relative to said track; and wherein said width of said main body of the wheelchair accessible ride vehicle does not substantially surpass the width of the main body of the at least second ride vehicle.

9. The wheelchair accessible ride vehicle of claim 8, wherein the main body of said the wheelchair accessible vehicle has a body shape asymmetrical relative to said track.

* * * * *